US005320348A

United States Patent [19]

Starrett

[11] Patent Number: 5,320,348

[45] Date of Patent: Jun. 14, 1994

[54] TELESCOPIC BATON WITH SHOCK ABSORBING MEANS

[75] Inventor: Paul D. Starrett, Jaffrey, N.H.

[73] Assignee: Monadnock Lifetime Products, Inc., Fitzwilliams

[21] Appl. No.: 16,680

[22] Filed: Feb. 11, 1993

[51] Int. Cl.[5] ..... F41B 15/02

[52] U.S. Cl. ..... 273/84 R; 135/75

[58] Field of Search ..... 273/84 R, 84 ES, 80 D; 285/298, 301, 302, 918; 135/75, 25.1, 25.3, 25.31, 26, 107, 108

[56] References Cited

U.S. PATENT DOCUMENTS

| | | | |
|---|---|---|---|
| D. 230,150 | 1/1974 | Anderson . | |
| D. 333,692 | 3/1993 | Parsons . | |
| 2,911,985 | 11/1959 | Granrath | 135/75 |
| 3,371,930 | 3/1968 | Shiga | 273/84 R |
| 4,037,839 | 7/1977 | Nelson | 273/84 R |
| 4,479,171 | 10/1984 | Mains . | |
| 4,667,958 | 5/1987 | Raitto | 273/84 R |
| 4,819,137 | 4/1989 | Hamilton | 273/84 R |
| 5,041,951 | 8/1991 | Fan | 273/84 R X |
| 5,108,097 | 4/1992 | Ashihara | 273/84 R |
| 5,110,375 | 5/1992 | Parsons | 273/84 R |
| 5,149,092 | 9/1992 | Parsons | 273/84 R |
| 5,160,140 | 11/1992 | Starrett | 273/84 R |
| 5,188,362 | 2/1993 | Ashihara | 273/84 R |

FOREIGN PATENT DOCUMENTS 462582 12/1991 European Pat. Off. ..... D22/, 80 D; 285 117 X R

OTHER PUBLICATIONS

Police, Mar. 1991, p. 15 "The Arsenal: Expanding Your Options" Top photo–expandable batons.

*Primary Examiner*—Vincent Millin
*Assistant Examiner*—William M. Pierce
*Attorney, Agent, or Firm*—Donald Brown

[57] ABSTRACT

A expandable police baton embodying a cylindrical sleeve within which is slidably disposed a cylindrical shaft. The sleeve and shaft are formed with flats to prevent rotation of the shaft within the sleeve. The baton also includes a shock absorbing assembly positioned on the shaft.

5 Claims, 3 Drawing Sheets

TELESCOPIC BATON WITH SHOCK ABSORBING MEANS

BACKGROUND OF THE INVENTION

Conventional police batons were at one time in the form of a rigid, one-piece, elongate, inextensible structure of solid cross section. More recently as shown in U.S. Pat. 5,160,140, there is disclosed a two-piece structure comprising a rigid, elongate, tubular structure and a rigid, elongate shaft disposed in the tube and movable therein relative to the tube from a contracted position to an expanded position. The invention in U.S. Pat. No. 5,160,140 which has been sold in the United States of America for many years and therefore is prior art to the invention of this application allows the police officer to carry the police baton much more easily when it is in the collapsed position.

The present invention is an improvement over the police baton shown in U.S. Pat. No. 5,160,140.

BRIEF SUMMARY OF THE INVENTION

The police baton of the invention includes a hollow tube (sleeve, frame) in which there is provided a partially cylindrical shaft which is supported in the tube for back and forth movement. The shaft is provided with a flat along its longitudinal surface and the hollow tube is provided with mating flat in the opening thereof to prevent the shaft from rotating in the tube. Shock absorbing means is provided on the shaft which cooperates with a stop of the tube to prevent the shaft from extending outwardly from the tube more than a predetermined distance. The shock absorbing means provides enhanced energy absorption when the shaft is caused by the user to move rapidly to an extended position.

BRIEF DESCRIPTION OF THE DRAWINGS

The invention will now be described in greater detail with reference to the accompanying drawings, wherein.

DETAILED DESCRIPTION OF THE DRAWINGS

Figure 6:
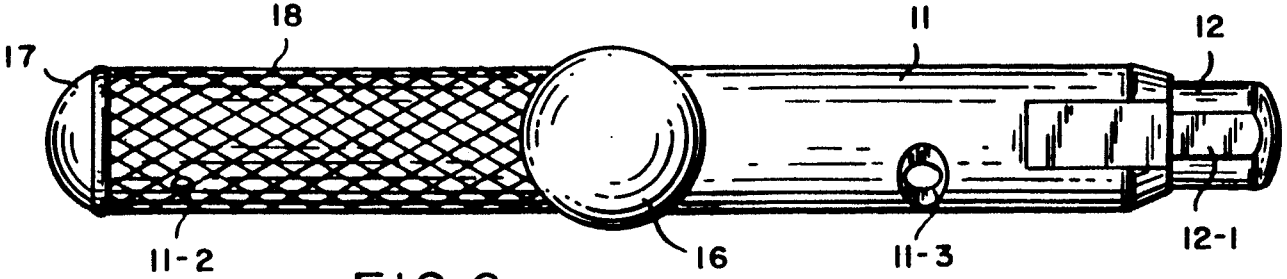
FIG. 6 is a bottom view of the baton in FIG. 1.
Figure 5:
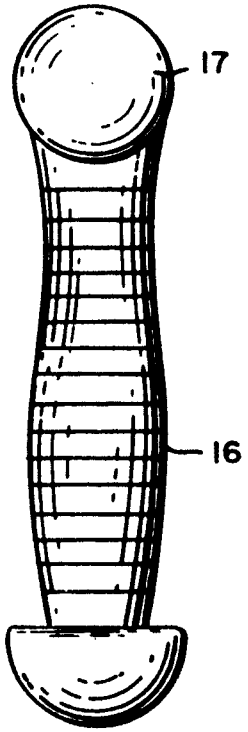
FIG. 5 is a rear view of the baton in FIG. 1.
Figure 10:
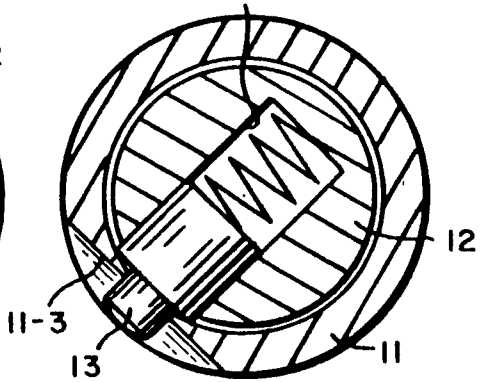
FIG. 10 is a sectional view taken along line 10—10 in FIG. 7.
Figure 9:
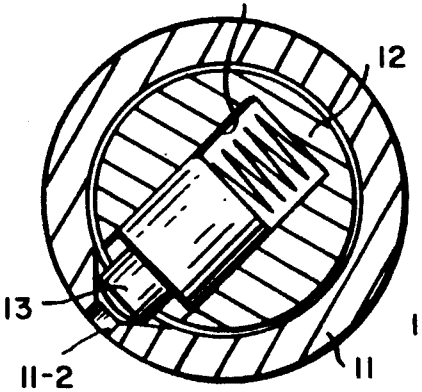
FIG. 9 is a sectional view taken along line 9—9 in FIG. 2.
Figure 8:
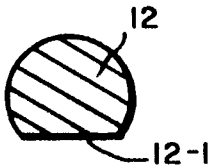
FIG. 8 is a sectional view taken along line 8—8 in FIG. 7.

Referring to the figures, the police baton of this invention comprises a cylindrical sleeve (frame) in the form of a hollow tube 11 within which is slidably mounted a partially cylindrical shaft 12 preferably of solid cross section having a partial flat 12-1. The sleeve 11 contains longitudinally disposed thumb groove 11-1 and counterbored opening 11-2. The shaft is provided at one end with a radial recess 19 containing a spring loaded pin 13 engageable with the opening 11-2 and 11-3 to hold the shaft 12 in the open or the closed position within the sleeve 11 (see FIGS. 9 and 10). The construction of the pin and holes is as disclosed in U.S. Pat. No. 5,160,140. The sleeve 11 has an open end at the rear and a cap 17 is threaded into a mating threaded open end of the sleeve (see FIG. 6). The cap 17 can be removed to permit the shaft 12 to be removed from the sleeve.

A flat 11-9 is formed within the sleeve in friction engagement with the shaft flat 12-1 for limiting rotation of the shaft 12 relative to the sleeve 11. To the rear of the flat 11-9 there is provided a stop 11-10 extending from the tube interior wall 11-7.

The stop 11-10 engages the shaft shock absorbing means 15 to limit forward movement of the shaft 12-1. The shaft shock absorbing means 15 includes a hard plastic ring 15-1 (e.g of nylon) and a pair of elastomeric O-rings (e.g. of buna rubber) 15-2 and 15-3 positioned in a shaft cutout 12-5 to the rear of the flat 12-1.

The sleeve 11 is preferably made of aluminum anodized on its surface. The shaft 12 may be of polycarbonate or aluminum and etc. The spring-biased pin 13 is preferably comprised of steel with black oxide on its surface an nylon, however, the exact nature of the material is not a feature of the invention.

To afford a firm grip on the baton, a portion 18 adjacent the closed end of the tube is preferably knurled.

The mouth end 11-6 of sleeve 15 is preferably swaged to provide the flat 11-9.

Figure 7:
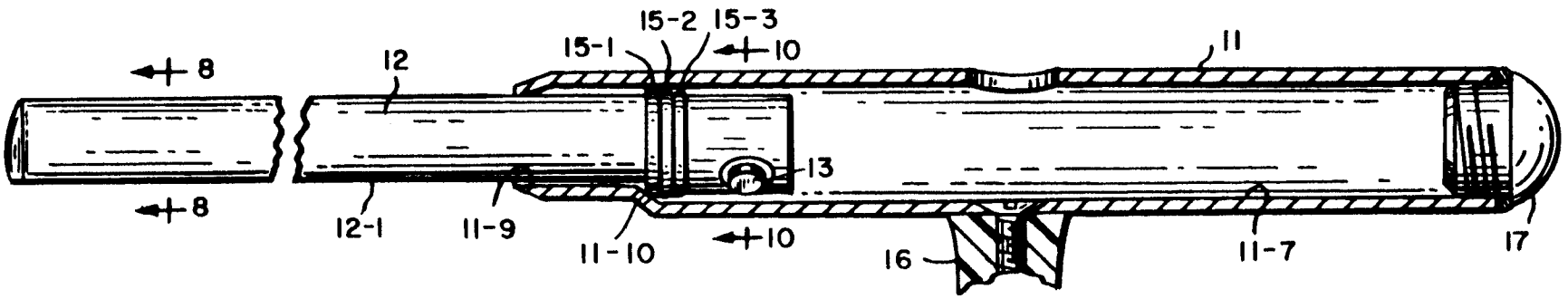
FIG. 7 is a partial cutaway of the invention showing the shaft in an extended position.
Figure 11:
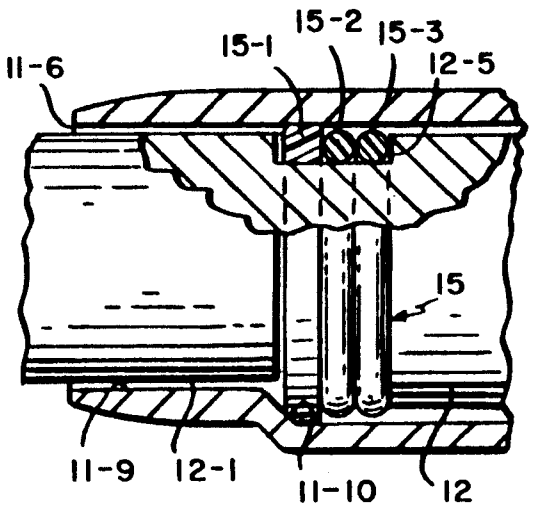
FIG. 11 is an enlarged partial sectional view showing the shock absorbing means according to the invention.

The baton may be provided with a radially-disposed side handle 16 fixed to the sleeve by a threaded screw screwed into the handle 16 as shown in U.S. Pat. No. 5,160,140 (incorporated by reference hereto by reference herein) and in FIG. 7.

Figure 1:
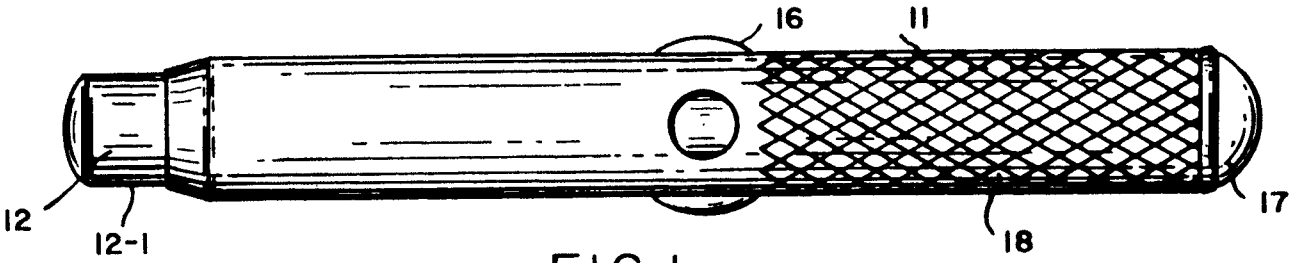
FIG. 1 is a side plan view of a police baton constructed according to this invention with the shaft in a retracted position.
Figure 2:
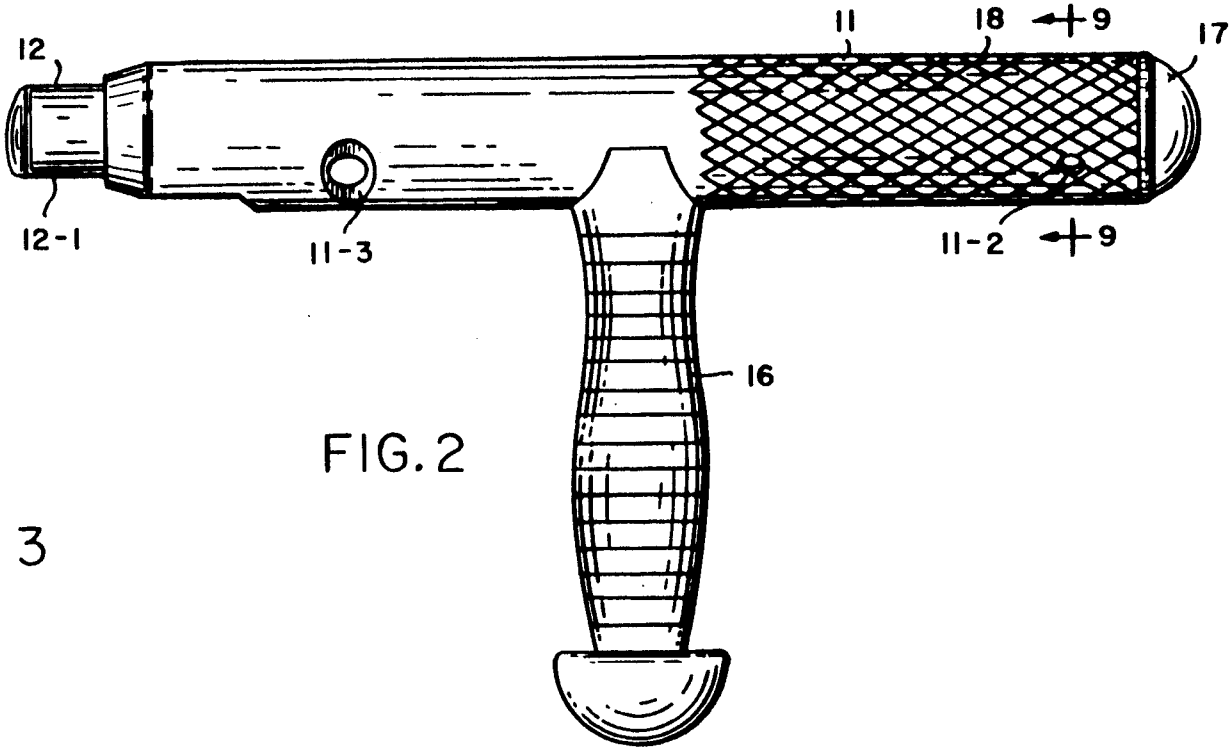
FIG. 2 is a side view of the baton in FIG. 1.
Figure 3:
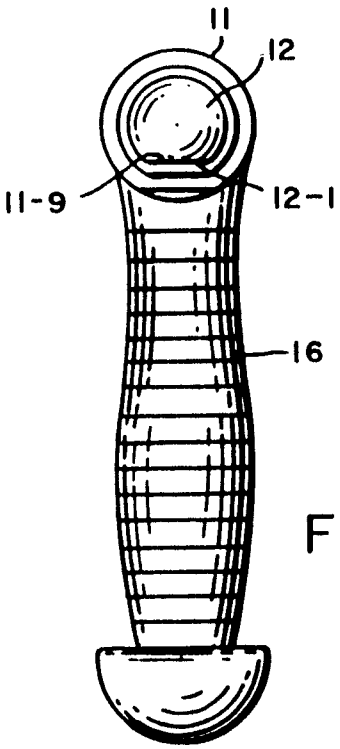
FIG. 3 is a front view of the baton of FIG. 1.
Figure 4:
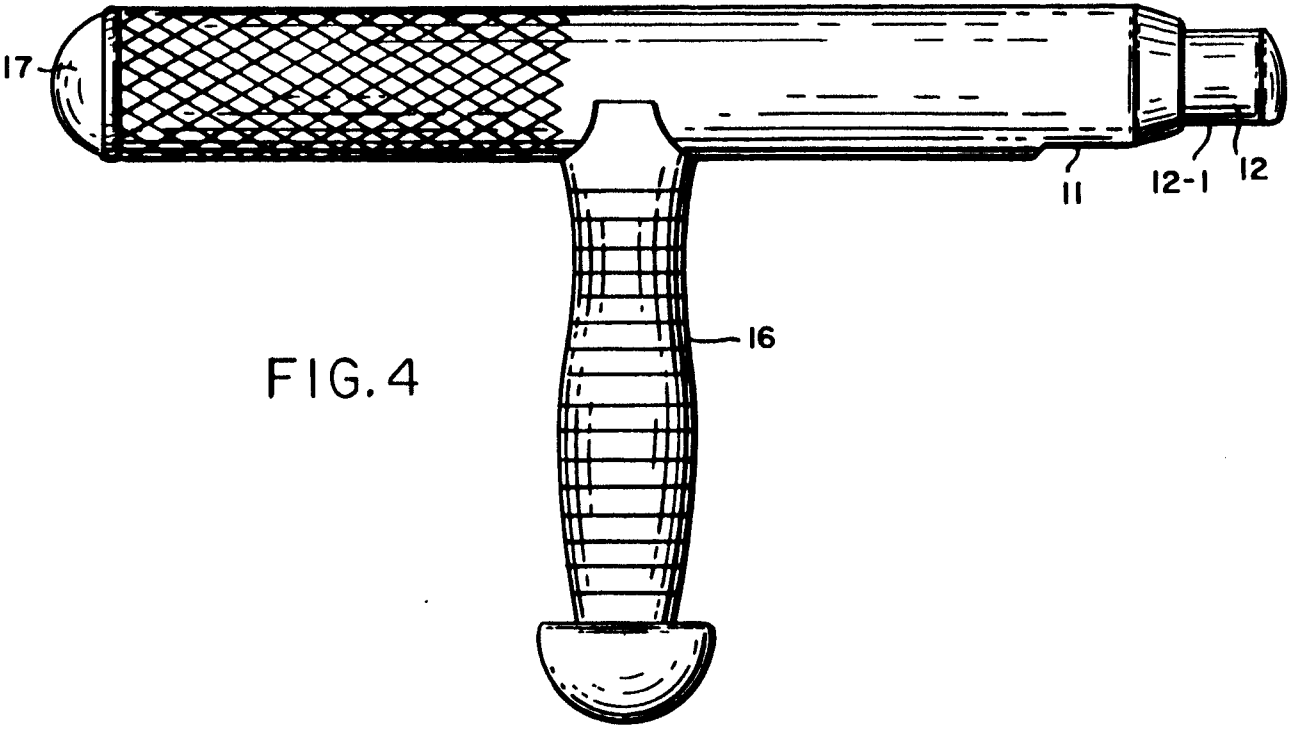
FIG. 4 is a side view of the opposite side of the baton in FIG. 1.

When carried by the policemen prior to use, the shaft 12 is usually in the retracted position as shown in FIG. 1.

To use the baton, the policeman sharply rotates the wrist and flicks the baton to cause the shaft 12 to cause the pin 13 to move out of the counterbored hole and move to the extended position. When the shaft is in the extended position (FIG. 7), the pin 13 extends into hole 11-3 which retains the shaft 12 in the extended position (see FIG. 7). To retract the shaft, the pin 13 is depressed below the hole opening 11-3 to permit the shaft 12 to be retracted as in FIG. 1.

It should be understood that the present disclosure is for the purpose of illustration only and includes all modification or improvements which fall within the scope of the appended claims.

What is claimed is:

1. A police baton comprising a hollow cylindrical, elongated frame having an open end, a cylindrical shaft for telescoping motion and at least partially disposed in the hollow interior of the frame, said shaft containing a longitudinally disposed flat and said frame having a matting flat surface at said open end thereof for preventing rotation of the shaft in the frame.

2. A police baton according to claim 1 wherein said cylindrical frame has a side and wherein a side handle is attached to the side of said cylindrical frame.

3. The police baton of claim 1 in which the shaft has a stop means to limit motion of the shaft within said frame.

4. A police baton comprising a hollow, cylindrical elongate tube having a front opening, a cylindrical shaft having a longitudinal flat, said shaft partially positioned within said tube for telescoping movement, said frame having a mating flat at the front opening thereof to prevent the shaft from rotating within the sleeve, said shaft having a partial axial cut out to the rear of the shaft flat, a shock absorber positioned on said shaft in said axial cutout, and said frame to the rear of the front opening providing a stop which the shock absorber engages when the shaft is thrust by the user to tis fully extended position with respect to the tube.

5. The baton according to claim 4 in which said shock absorber comprises at least one elastomeric O-ring.

* * * * *